US005478268A

United States Patent [19]

Au

[11] Patent Number: 5,478,268

[45] Date of Patent: Dec. 26, 1995

[54] ELECTRONIC EDUCATIONAL TOY APPARATUS

[75] Inventor: Ip-Sing Au, Tsuen Wan, Hong Kong

[73] Assignee: Vtech Industries, Inc., Wheeling, Ill.

[21] Appl. No.: 297,318

[22] Filed: Aug. 29, 1994

[51] Int. Cl.[6] ..... A63H 5/00

[52] U.S. Cl. ..... 446/227; 446/397

[58] Field of Search ..... 446/227, 397, 446/297, 303; 273/375, 374, 381; 434/335, 308, 258; 119/708, 707

[56] References Cited

U.S. PATENT DOCUMENTS

| | | | |
|---|---|---|---|
| 4,551,114 | 11/1985 | Hyman et al. | 446/227 X |
| 4,561,548 | 12/1985 | Yokohori | 211/182 |
| 4,594,072 | 6/1986 | Cowell | 446/227 |
| 4,627,588 | 12/1986 | Block | 248/163.2 |
| 4,722,713 | 2/1988 | Williams et al. | 446/227 |
| 4,973,286 | 11/1990 | Davison | 446/227 X |
| 5,057,051 | 10/1991 | Babicz | 446/227 |
| 5,076,520 | 12/1991 | Bro | 248/165 |
| 5,250,002 | 10/1993 | Kinberg | 446/220 |

FOREIGN PATENT DOCUMENTS

| | | | |
|---|---|---|---|
| 2207984 | 2/1989 | United Kingdom | 446/227 |

OTHER PUBLICATIONS

Gymfinity product, by Today's Kids of Booneville, Ark. Photocopies of portions of packaging and photos of product Believed to have been on sale in U.S. at least as early as Aug. 20, 1993.

*Primary Examiner*—Mickey Yu
*Attorney, Agent, or Firm*—Dick and Harris

[57] ABSTRACT

An electronic educational toy apparatus is provided, in which a plurality of toy articles are suspended from a support, such that an infant may be positioned within reach of the toy articles, and may touch, hit or kick the toy articles whereby each touch, hit or kick of the toy articles triggers an audible presentation to the infant.

10 Claims, 1 Drawing Sheet

ELECTRONIC EDUCATIONAL TOY APPARATUS

BACKGROUND OF THE INVENTION

The present invention is directed to apparatus for suspending articles above a surface, such as the kinds of apparatus which are used to suspend hanging toys above an infant. Such apparatus may be free standing, on some form of tripod or quadrupedal arrangement, or may be configured to suspend from a support above the infant's location, such as from a ceiling, or from a cantilevered, or overarching support, such as may be attached to one or both of the sides of a crib.

Prior art infant toy suspension apparatus, such as are represented by Yokohori, U.S. Pat. No. 4,561,549; Block, U.S. Pat. No. 4,627,588; and Bro, U.S. Pat. No. 5,076,520, typically comprise a tubular support, which may be articulated, and from which one or more toy articles are suspended, as by fabric or plastic straps. The toy articles typically are fabricated from a plastic or other non-toxic material, in a variety of shapes and colors, so as to be visually pleasing and interesting to the infant, and are further typically fabricated in such a manner as to withstand use by the infant as a teething article, without harm to the infant, or significant damage to the toy article. The toy articles are typically suspended so as to just be within, or perhaps even slightly beyond the easy reach of the infant, when the infant is placed on a floor surface, or within a child's seat, beneath the suspended toy articles, so as to encourage a limited amount of physical activity in the infant as the infant plays with the toy articles.

In addition, the toy articles may be hollow and filled with a granular substance, or have bell apparatus mounted therewithin, so as to provide some audible stimulation to the infant, when the infant touches the suspended toy articles.

While such toy articles may have a beneficial effect in that they provide some limited stimulation and amusement to the infant, there remains the possibility that the infant may become bored and/or restive due in part to the feedback to their activity being the mere motion of the toy articles or repetitive sounds produced thereby. While electronic learning aid devices have been developed and are marketed to infants and young pre-school children which devices provide audible outputs in response to pressing buttons, moving levers, during dials and the like, where such outputs take the form of human speech or musical sounds familiar or understandable to the user, such devices are typically inappropriate for very young infants given that they typically lack the coordination and dexterity required to manipulate buttons, levers and dials and thus can not make full use of such devices until the later stages of infancy, or later.

Accordingly, it would be desirable to provide an infant's suspended toy which is capable of providing greater stimulus to the young infant, so as to encourage greater use and activity from the infant.

It would be further desirable to provide an infant's suspended toy apparatus which both entertainment and educational value which can be delivered to the infant during use.

These and other objects of the invention will become apparent in light of the present specification, claims and drawings.

SUMMARY OF THE INVENTION

The present invention is directed to an electronic educational toy apparatus for use by infants, comprising a housing; means for supporting the housing in an elevated position above a surface, the means for supporting the housing being operably arranged relative to the housing so as to enable an infant to be positioned beneath the housing, between the housing and the surface; at least one shaped article movably suspended from the housing, the shaped article normally being positioned in a resting suspended position relative to the housing when the housing is supported by the means for supporting the housing; means, operably associated with the housing and the shaped article, for providing an audible presentation upon movement of the at least one shaped article from a position away from the resting suspended position, the presentation including an indication of at least one characteristic of the shaped article.

In a preferred embodiment of the invention, the at least one shaped article has a shape representative of an animal. In an alternative preferred embodiment, the at least one shaped article has a shape representative of a geometric figure such as a triangle, circle or square.

The electronic educational toy apparatus further may comprise switch means, operably associated with the housing and actuatable by the infant, for providing a further audible presentation associated with the at least one shaped article. In an embodiment in which the at least one shaped article has a shape representative of an animal, the further audible presentation triggered by actuation of the switch means comprises a simulated sound such as is commonly recognized as being made by the animal.

In an embodiment in which the at least one shaped article has a shape representative of an animal, the audible presentation comprises a verbal identification of the animal. In an embodiment in which the at least one shaped article has a shape representative of a geometric figure, the audible presentation comprises a verbal identification of the geometric figure.

In a preferred embodiment of the invention, the means for supporting the housing in an elevated position above a surface comprise one or more support legs, operably arranged on the housing, for standing the housing above the surface. Alternatively, the means for supporting the housing in an elevated position above a surface may comprise hanging means for suspending the housing from a further support positioned above the surface. It is contemplated that, alternatively, the means for supporting the housing in an elevated position above a surface may comprise hanging means for suspending the housing in a laterally extended manner from a vertically extending support, such as a wall, disposed adjacent to and extending upwardly from the surface.

The electronic educational toy apparatus further includes detection means, operably associated with the housing, the at least one shaped article, and the means for providing an audible presentation, for detecting and indicating to the controller means for providing an audible presentation, movement of the at least one shaped article away from the resting suspended position.

The electronic educational toy apparatus may also comprise means, operably associated with the housing, and actuatable by the infant, for providing an audible musical presentation, upon movement of the at least one shaped article away from the resting suspended position.

DETAILED DESCRIPTION OF THE DRAWINGS

Figure 1:
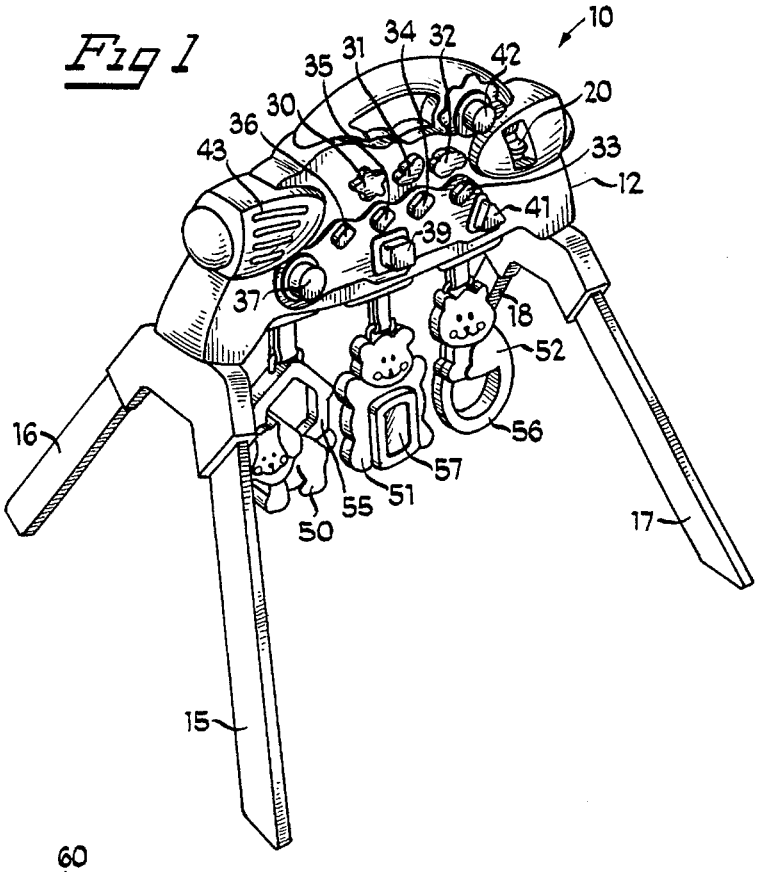
FIG. 1 is a perspective view of the electronic educational toy apparatus, according to a preferred embodiment of the invention.

While this invention is susceptible of embodiment in many different forms, there is shown in the drawings and will be described in detail herein a specific embodiment, with the understanding that the present disclosure is to be considered as an exemplification of the principles of the invention and is not intended to limit the invention to the embodiment illustrated.

Electronic educational toy apparatus 10 is illustrated in a representative configuration in FIG. 1. Apparatus 10 includes housing 12 with integrated handle 13, and support legs 15–18. A multiposition mode selector switch 20, enables apparatus 10 to be activated, and switched between a plurality of operational modes, as discussed in further detail hereinafter.

A plurality of activity buttons, 30–41, are provided, together with light 42 which may be illuminated in response to various actions by a user infant. Activity buttons 30–41 may have different geometric shapes, or the stylized shapes of a musical note, a star, a crescent moon, or a cloud, as illustrated. Appropriate electronic control circuitry is appropriately mounted within housing 12. Controller circuitry, in the preferred embodiment, comprises an electronic digital controller, digital memory means and means for producing audible presentations, including speech synthesis apparatus, amplifier and speaker apparatus, as are already known in the art (not shown), and housed within housing 12. Suitable speaker apparatus is positioned underneath or in the vicinity of speaker grille 43.

Suspended from housing 12, in a pivotable manner, to be described, are toy articles 50–52. In a preferred embodiment, toy articles 50–52 have stylized animal shapes, namely, a dog, a bear, and a cat, respectively. Alternatively, the toy articles may be of virtually any shape or color including geometric shapes, flower shapes, or human shapes. Toy articles 50–52 preferably are fabricated from a non-toxic, durable plastic material, such that an infant may safely teethe on such articles, without danger of being harmed by the material, or by having the article break under the stress. Toy articles 50–52 may also incorporate additional features, such as grasping portions 55, 56, or a mirror portion 57.

Figure 2:
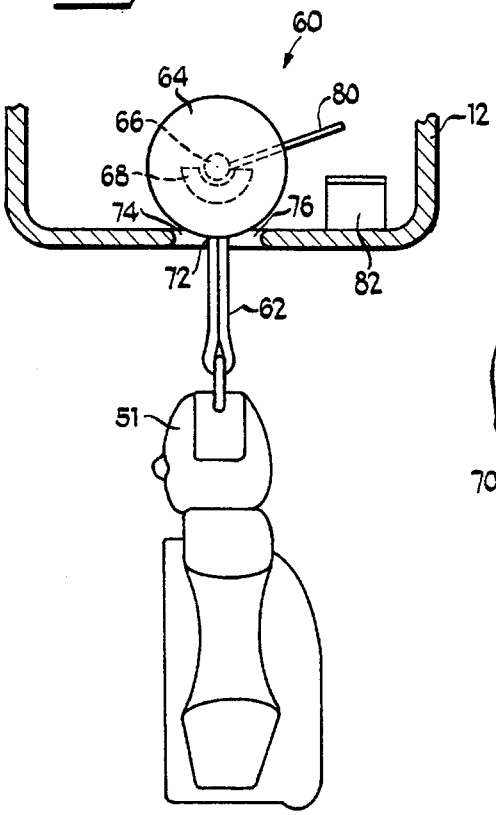
FIG. 2 is a side elevation, partially in section, showing the switch and pivot assembly.
Figure 3:
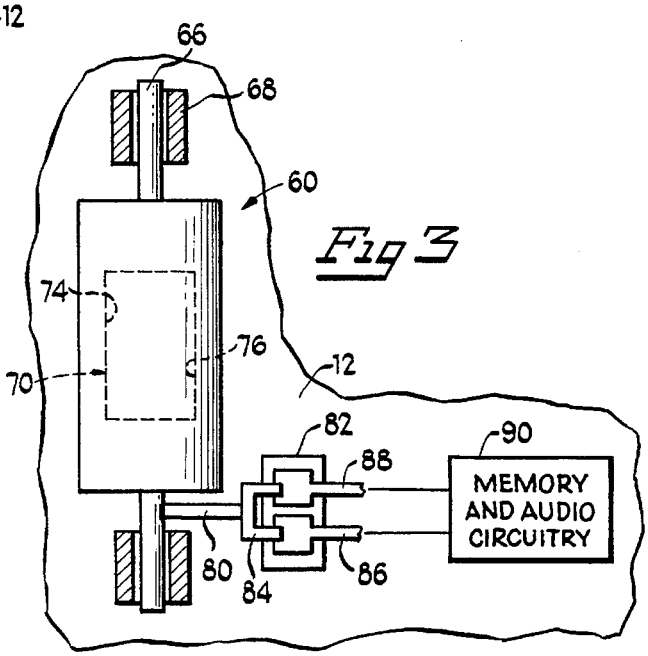
FIG. 3 is a top plan, partially in section, of the switch and pivot assembly, according to FIG. 2.

Each of toy articles 50–52, is suspended from housing 12 by a pivot assembly 60, as illustrated in FIGS. 2–3. In particular, each toy article, such as bear-shaped toy article 51, is suspended by a flat ribbon 62, which preferably is fabricated from a nylon or other plastic mesh material, and suitably affixed at one end to the toy article. An opposite end of ribbon 62 is affixed to drum 64 which is pivotably mounted within housing 12 on trunnions 66, which are seated in gudgeons 68, which may be integrally formed or affixed to the interior surface of housing 12. Each drum 64 is positioned proximate to aperture 70 in housing 12, which aperture 70 has a width and length which is slightly less than the diameter and length of drum 64, respectively. The amount of rotation which each drum 64 may undergo is limited by the ribbon 62, which, preferably, is thick enough so as to prevent the point of attachment 72 from being pivoted past either the leading edge 74 or the trailing edge 76 of aperture 70.

A switch arm 80 is shown affixed to one of trunnions 66, and operably arranged so as to pivot into contact with a switch base 82, which may be mounted onto the interior surface of housing 12. Switch arm 80 may include a forked electrical connector member 84. Mounted on the top of switch base 82 may be two electrical contacts 86, 88, which are connected electrically to controller circuitry 90 (illustrated schematically), which may be of conventional configuration as described above. Switch arm 80 is mounted in relation to drum 64, such that when toy article 51 is at rest, it hangs substantially straight down, and switch arm 80 is positioned above switch base 82, in an "open circuit" position. When an infant pushes or kicks toy article 51 away, on the return swing, the switch arm 80 will contact switch base 82, and connector member 84 will electrically connect electrical contacts 86, 88, and indicate to controller circuitry 90 that a specific toy article 51 has been set in motion by the infant.

Electronic educational toy apparatus 10 may be configured to have a plurality of modes of operation. For example, toy apparatus 10 may have both a voice mode and a music mode. Operation may begin when the mode selector switch 20 is moved from an "off" position, to a "voice" position.

In the "voice" mode, when the infant kicks at one of the toy articles, for example the bear shaped article 51, the controller circuitry 90 having been appropriately programmed or set up produces an audible presentation in human speech such as "Hello, I am the bear." In this same mode, the activity button 39 positioned above the bear shaped toy article 51, may have an illustration thereon of a honey pot, and when pressed, may result in an audible presentation, such as "This is my honey", a phrase associated with the subject matter of the toy article, in this case a bear. Similarly, the dog-shaped toy article 50, and the cat-shaped toy article, 52 may have similar audible presentations, when kicked, and their respective activity buttons 37 and 41, may have suitable corresponding illustrations and audible presentations.

In the "voice" mode, activity buttons 30–36, may have musical, or spoken phrase audible presentations programmed to be heard, when the respective activity buttons are pressed.

When mode selector switch 20 is shifted to a "music" mode, for example, toy articles 50–52, when kicked, may cause controller circuitry 90 to produce a series of animal sound effects, such as the respective animals may be expected to make (the "dog" barks, the "bear" growls, the "cat" meows), which animal sound effects may be followed by a short melodic tune. Activity buttons 37, 39, 41, which have separate geometric shapes, may have spoken word audible presentations associated with them, which may identify their respective shapes, such as "square". The remaining activity buttons may be so connected to the circuitry, so as to "play" other musical tunes, or individual notes. Alternatively, or in addition thereto, the audible presentation to the infant can comprise other characteristics associated with the toy articles 50–52 such as an identification of their color.

The "sun" shaped light 42 may be connected to electronic circuitry, 90 so as to be illuminated randomly, in response to the pressing of a button, or the movement of one of the toy articles, or in time to a played musical tune, as may be desired.

The controller circuitry 90, which is illustrated only schematically, may be of known configuration, and may be programmed or otherwise set up to provide the indicated audible presentations, or presentations of a similar nature. As described hereinabove, the controller circuitry 90 provides an audible presentation only upon actuation of one of the activity buttons, or upon movement of one of the toy articles.

Alternatively, the controller circuitry 90 may be configured such that, upon actuation of the mode selector switch from the "off" position, an audible presentation, making a demand or presenting a question of the infant, may be produced. For example, the question "Which is the bear?" may be produced. If the infant were to kick the bear shaped toy article, then in addition to the "Hello, I am the bear" message, an additional audible message of encouragement or congratulation may be provided. Such a mode of operation would be appropriate for the older, more advanced infant or child who nevertheless may still lack the degree of coordination or dexterity required to manipulate buttons, levers dials and the like.

The apparatus 10 of FIG. 1 is illustrated in a free-standing configuration. However, it is contemplated that the apparatus may also be provided with a ribbon loop on or as part of handle 13, such that apparatus 10 (minus legs 15–18, which may be configured to be insertably removable) may be hung from a ceiling, or an overhanging rod, etc. In addition, the back side of housing 12 may be provided with suitably configured slots for receiving buckled straps for attachment of housing 12 to the side of a crib or the like, as is well known in the art.

While the configuration of pivot assembly 60 is as illustrated, other configurations for detecting the movement of toy articles 50–52 may be employed, while still accomplishing the desired operation of the invention. In addition, in a preferred embodiment of the invention, controller circuitry 90 is configured so as to produce only one single audio presentation, per movement of each toy article, without repetition, even if the infant were to hold a toy article in such position, that contact member 84 is held against electrical contacts 86 and 88. Other types of switching arrangements and control responses may be employed as desired.

It is believed that the present invention holds a distinct advantage over prior art suspended toy apparatus, in that by providing an audible presentation, of either voice, or sound effect, which is in relation to the shape and/or configuration of the suspended toy article, the apparatus of the present invention will be capable of retaining the infant or child's attention, and may have some informative or educational effect as well, in combination with encouraging enhanced or increased physical activity.

The description and drawings herein merely explain and illustrate the invention, and the invention is not limited thereto except insofar as the appended claims are so limited, as those skilled in the art who have the disclosure before them will be able to make modifications and variations therein without departing from the scope of the invention.

What is claimed is:

1. An electronic educational toy apparatus for use by infants, comprising:

a housing;

means for supporting said housing in an elevated position above a surface;

said means for supporting said housing being operably arranged relative to said housing so as to enable an infant to be positioned beneath said housing, between said housing and said surface;

at least one shaped article, operably associated with said housing, movably suspended from said housing, said at least one shaped article normally being positioned in a resting suspended position, relative to said housing, when said housing is supported by said means for supporting said housing;

means for suspending said at least one shaped article from said housing;

means, operably associated with said housing and said means for suspending said at least one shaped article, and operably disposed externally to and in spaced relation to said at least one shaped article, for providing an audible presentation, said presentation including an indication of at least one characteristic of said at least one shaped article, upon movement of said at least one shaped article away from said resting suspended position.

2. The electronic educational toy apparatus according to claim 1, wherein said at least one shaped article has a shape representative of an animal.

3. The electronic educational toy apparatus according to claim 1, wherein said at least one shaped article has a shape representative of a geometric figure.

4. The electronic educational toy apparatus according to claim 1, further comprising:

switch means, operably associated with said housing and actuatable by said infant, for providing a further audible presentation associated with said at least one shaped article independent of the movement of said at least one shaped article.

5. The electronic educational toy apparatus according to claim 1, wherein said at least one shaped article has a shape representative of an animal, and further the audible presentation associated with said at least one shaped article comprises a simulated sound which is commonly recognized as being made by said animal.

6. The electronic educational toy apparatus according to claim 1, wherein said at least one shaped article has a shape representative of an animal and said audible presentation comprises a verbal identification of said animal.

7. The electronic educational toy apparatus according to claim 1, wherein said at least one shaped article has a shape representative of a geometric figure and said audible presentation comprises a verbal identification of said geometric figure.

8. The electronic educational toy apparatus according to claim 1, wherein said means for supporting said housing in an elevated position above a surface comprise one or more support legs, operably arranged on said housing, for standing said housing above said surface.

9. The electronic educational toy apparatus according to claim 1, wherein said means for providing an audible presentation further includes:

detection means, operably associated with said housing, said at least one shaped article, and said means for providing an audible presentation, for detecting and indicating to said means for providing an audible presentation, movement of said at least one shaped article away from said resting suspended position.

10. The electronic educational toy apparatus according to claim 1, further comprising:

means, operably associated with said housing, and actuatable by said infant, for providing an audible musical presentation, upon movement of said at least one shaped article away from said resting suspended position.

* * * * *